United States Patent [19]

Gaber

[11] 4,161,326

[45] Jul. 17, 1979

[54] SKATEBOARD

[76] Inventor: Steven L. Gaber, 12208 Wallingstone La., Austin, Tex. 78759

[21] Appl. No.: 765,656

[22] Filed: Feb. 4, 1977

[51] Int. Cl.[2] ..... A63C 17/14

[52] U.S. Cl. ..... 280/87.04 A; 280/11.2

[58] Field of Search ..... 180/87.04 A, 87.04 R, 180/11.19, 11.27, 11.28, 11.2, 11.1 R, 11.1 BR, 11.1 BT, 603, 601; D34/15 AJ

[56] References Cited

U.S. PATENT DOCUMENTS

| | | | |
|---|---|---|---|
| D. 242,735 | 12/1976 | Candler | D34/15 AJ |
| D. 243,206 | 1/1977 | Sherwood | D34/15 AJ |
| 2,198,667 | 4/1940 | Hagenes | 280/87.04 A |
| 2,516,644 | 7/1950 | Post et al. | 280/11.2 |
| 2,631,861 | 3/1953 | Daniska | 280/11.2 |
| 3,565,454 | 2/1971 | Stevenson | 280/87.04 A |
| 3,954,279 | 5/1976 | Guerr | 280/87.04 A |
| 3,990,713 | 11/1976 | Hokanson | 280/87.04 A |
| 3,995,873 | 12/1976 | Pantzar | 280/87.04 A |
| 4,031,988 | 6/1977 | Hill | 280/87.04 A |
| 4,040,639 | 8/1977 | Scardenzan | D34/15 AJ |

FOREIGN PATENT DOCUMENTS

| | | | |
|---|---|---|---|
| 101194 | 3/1941 | Sweden | 280/601 |

OTHER PUBLICATIONS

"Logan Earth Ski", Skateboarder Magazine, vol. 2, #6, Aug. 1976, p. 38.

*Primary Examiner*—David M. Mitchell

*Attorney, Agent, or Firm*—Burton & Dorr

[57] ABSTRACT

An improved skateboard having a replaceable arc-tail with a wear surface and further having wheel wells. Each end of the improved skateboard may have the arc-tail with the inwardly directed angular wear surface for enabling the operator to perform a variety of new tricks. In addition, each end of the skateboard may further be replaceable so that as the end of the skateboard wears out that end may be replaced. Furthermore, formed wheel wells are provided in the bottom surface of the skateboard to prevent the wheels from touching the bottom surface of the skateboard during turns and the like.

5 Claims, 12 Drawing Figures

SKATEBOARD

BACKGROUND OF THE INVENTION

1. Field of the Invention

The present invention relates primarily to skateboards.

2. Description of the Prior Art

Skateboards have been in existence for at least the last fifteen years. A 1966 patent issued to Bostick, U.S. Pat. No. 3,235,282 discloses the use of a skateboard provided with adjustable wheels which can be adjusted to a plurality of different positions since each wheel carriage unit is slidably disposed on a track. A 1971 patent issued to Stevenson, U.S. Pat. No. 3,565,454 features the use of a sloped, upwardly and rearwardly rear section of the skateboard which allows the skateboard user to perform complicated spinning or pivoting maneuvers. The rear end of Stephenson's invention is preferably formed from a U-shaped tube having a pair of arms that converge rearwardly and terminate at and merge in a crosspiece. The design patent issued to Noches, Design Pat. No. 222,158 also shows a skateboard having an inclined-tilted rear end. A 1973 patent issued to Bueno, U.S. Pat. No. 3,771,811 provides a foot-activated steering rear element which allows the operator to change direction at will. A right foot stop is further provided in Bueno to permit more positive engagement of the right foot with the front of the skateboard.

In addition to the above prior patents, at the time of this application, the inventor is aware of the following prior art approaches. A "wheel well" skateboard is shown on Page 32 of "The Skateboard Book". The "wheel well" skateboard has formed notches cut into the side of the skateboard so that the portion above each wheel is not covered. Current manufacturers of such wheel well boards are "ARROWSMITH" and "LOGAN EARTH SKI".

None of the above prior art approaches anticipate or render obvious the applicant's present invention wherein an arcuate tail is designed based upon specific design parameters to enable maximum maneuverability and flexibility in performing tricks and the like. Furthermore, none of the above prior art approaches anticipate nor render obvious the applicant's concept of wheel wells in which each wheel well is formed in the bottom surface of the skateboard so that the entire upper surface of the skateboard may be utilized by the operator without the possibility of the operator engaging his foot on the wheel. Furthermore, the improved skateboard of the present invention provides a replaceable tail which enables the skateboard to be continually reused with only the wearing surfaces on each end being replaced. The great expense in skateboards is the truck and wheel assembly and the improved skateboard of the present invention eliminates this great expense by continually using the skateboard proper which is mounted to the truck and wheel assembly. Furthermore, the new and improved skateboard of the present invention provides an arcuate tail having a wear angle critically designed to provide maximum maneuverability and flexibility in executing tricks and the like on the board.

OBJECTS OF THE INVENTION

It is an object of the present invention to provide a new and improved skateboard.

It is another object of the present invention to provide a new and improved skateboard having front and rear wheels, with a board extending over the front and rear wheels wherein the improvement comprises a cavity formed in the bottom surface of the board over each of the wheels so that the cavity extends from the bottom surface of the board to a region below the upper surface of the board.

It is another object of the present invention to provide a skateboard having front and rear wheels with a board extending over the wheels wherein the improvement comprises a tail extending rearwardly from the rear end of the board and a means for releasably coupling the tail to the rear end of the board.

It is another object of the present invention to provide a new and improved skateboard having wheels located under opposing ends of a longitudinal board wherein the improvement comprises one end of the board terminating in a first-formed arc on the upper surface and a second-formed arc inward from the first arc on the bottom surface, so that the angular surface between the first and second arcs is inwardly directed.

It is still another object of the present invention to provide a new and improved skateboard having wheels located under opposing ends of a longitudinal board wherein the improvement to one end of the board comprises the end terminating on the upper surface in a first-formed arc and on the lower surface a second-formed arc so that the angular surface between the upper and lower surfaces is inwardly directed and further comprising means for releasably coupling the portion of the board containing the angular surface to the portion of the board above it.

SUMMARY OF THE INVENTION

The present invention comprises an improved skateboard having formed wheel wells in close proximity to the upper surface of the wheels and formed in the bottom surface of the skateboard wherein a cavity is formed over each wheel from the bottom surface upwardly to a region near the upper surface of the board. The formed wheel wells are strategically located in orientation to the position of the wheels and are substantially triangular in shape at the intersection of the cavity with the bottom surface of the board so that the apex of the triangular shape is angularly disposed from the centerline of the board and the centerline of the wheel axles.

The longitudinal ends of the improved skateboard are formed in uniquely shaped arcs wherein the radius of the arc is the distance from the junction of the longitudinal centerline with the centerline of the axle which is the center of the arc. The arc-tail further has an inwardly disposed angular wear surface which enables the operator of the improved skateboard to perform new and improved maneuvers with the skateboard. The bottom surface of the skateboard is vertically placed in a particular distance from the ground which distance is proportional to the diameter of the wheels and furthermore the arc's radius is in a particular relationship to the distance from the bottom of the board to the ground.

The tails are designed so that they may be selectively replaced after severe wear without necessitating the cost of replacing the entire skateboard.

Other objects, advantages and capabilities of the present invention will become more apparent as the description proceeds, taken in conjunction with the accompanying drawings.

DETAILED SPECIFICATION

Figure 1:
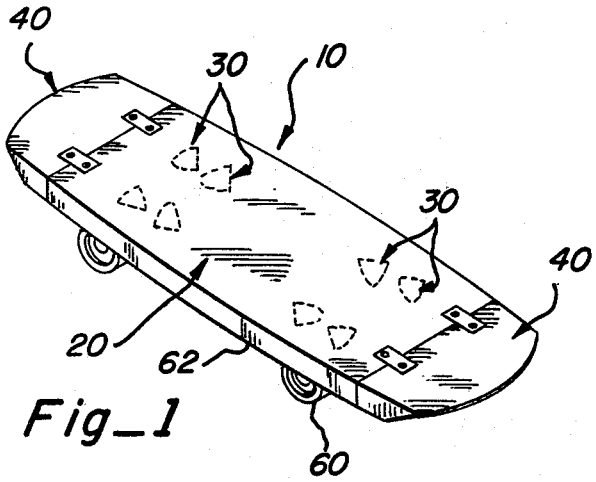
FIG. 1 is a perspective view of the new and improved skateboard of the present invention.
Figure 2:
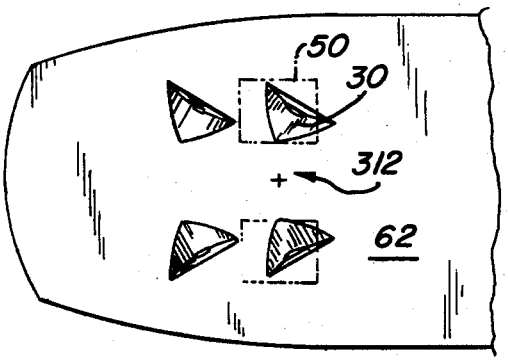
FIG. 2 is a bottom planar view of four "gouge-type" wheel wells.

In FIGS. 1 and 2, is shown the preferred embodiment of the new and improved skateboard 10 of the present invention to include a main board section 20, having wheel wells 30 formed therein, and an arcuate, replaceable tail 40 appearing on both ends of the skateboard 10. In operation, the wheel wells 30 enable the operation of the skateboard 10 to tilt the skateboard sideways thereby allowing the wheel 60 to enter into the wheel well 30 without engaging the bottom surface 62 of the skateboard 10. The provision of the wheel well 30 on the improved skateboard 10 will enable the operator of skateboard 10 to perform new tricks that have been to date impossible to perform. Furthermore, the provision of the replaceable tail 40 enables a more economical skateboard since the tail, whether it is of the arc-shape shown in FIG. 1 or of a standard skidplate design, can be easily replaced without the expensive cost of purchasing a new board complete with trucks and wheels.

Figure 3:
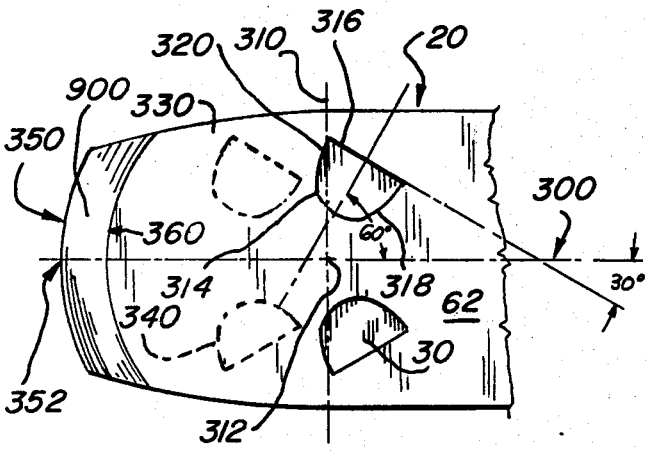
FIG. 3 is a bottom planar view of a portion of the new and improved skateboard of the present invention illustrating the placement of "cut-away" wheel wells and the arc-tail wear surface.

In FIG. 3, the longitudinal axis 300 of the skateboard 10 is shown to perpendicularly intersect with the centerline 310 of the wheels 60 (not shown in FIG. 3). A point of intersection 312 exists between the longitudinal centerline 300 and the centerline of the wheels axle 310. Each wheel well cavity 30 is substantially triangular in shape at the intersection of the cavity with the bottom surface 62 of the midsection 20. Each wheel well 30 has one apex 314 which is an arcuate surface angularly disposed from the centerline 300 which, in FIG. 3, is preferably 60°. It is to be expressly understood that while 60° is preferable for the preferred embodiment that any orientation of the apex, and, therefore, the cavity, may be used including the preferable range of 45°–75°. Opposing apex 314 is a linear surface 316 which forms an angle of 30° with the centerline 300 of the board. Interconnecting the linear edge 316 with apex 314 are two identical and opposing arcuate surfaces 318 and 320. While two wheel wells 30 are shown in FIG. 3 and are oriented towards the center of the skateboard 10, two additional wheel wells 330 and 340, as shown by dotted lines, may also be formed in the skateboard to provide greater flexibility.

Figure 4:
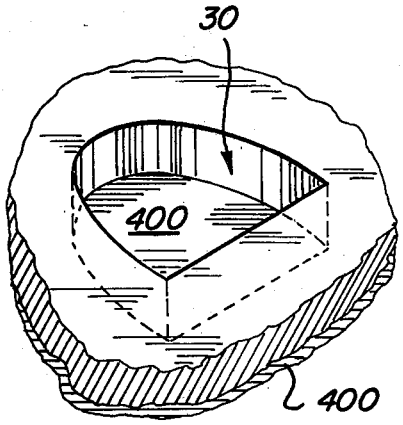
FIG. 4 is a partial perspective view of the "cut-away" wheel well of FIG. 3.

In FIGS. 3 and 4, is shown a first preferred shape of wheel wells. For convenience, this shape will be termed "cut-away", since in the preferred construction of the skateboard 10 of the present invention, the wheel wells, as shown in FIG. 3, are cut out and then the top surface 400 is laminated over the cutout board, thereby covering the upper portion of the wheel wells 30. In this manner, the operator of the improved skateboard 10 will not have his feet engaging the wheels on turning since the formed cut-away wheel well 30 termiates at a region near the upper surface 400.

Figure 5:
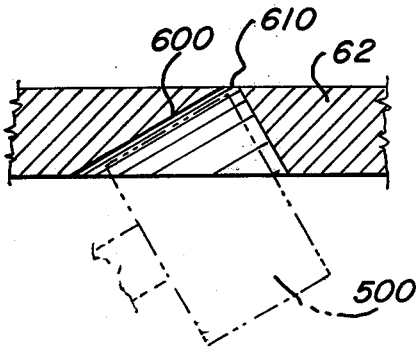
FIG. 5 is a side cut-away view of the "gouge-type" wheel well of FIG. 2 being formed.
Figure 6:
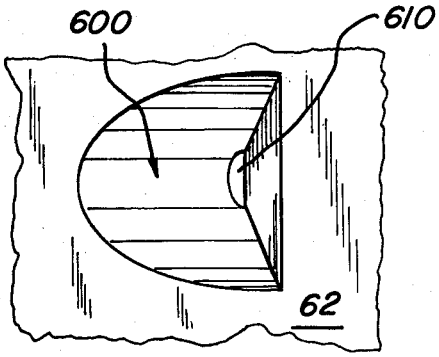
FIG. 6 is a bottom planar view of a "gouge-type" wheel well.

In FIGS. 2, 5, and 6, is shown a second preferred shape for the wheel well 30 which is conveniently termed the "gouge-type" wheel well. The cavity portion 600 as shown in FIG. 6 is that of a segment of a cone, wherein the sides of the cavity taper downwardly from the bottom surface 62 to a point or region 610 near the upper surface, not shown, of the skateboard 10. A cylindrical cutting tool 500 can be used to cut the cone segment as shown in FIG. 5. An upper layer, not shown in FIG. 5, exists over the cavity.

Figure 7:
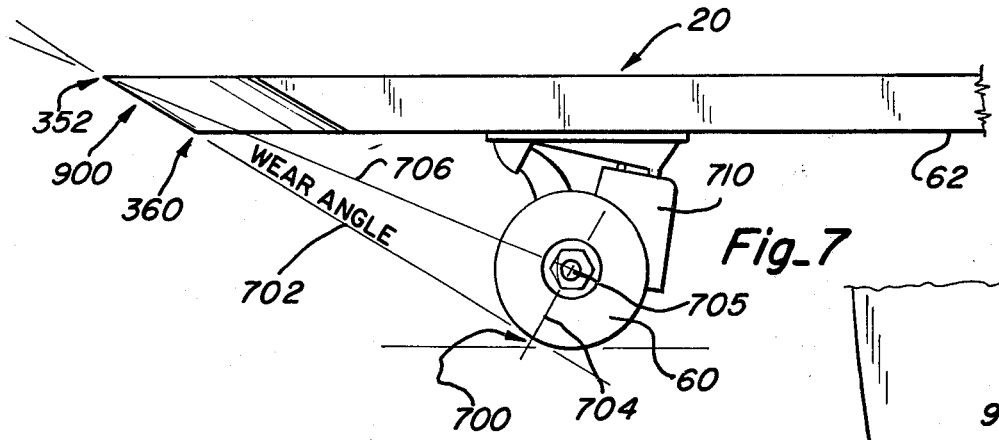
FIG. 7 is a side planar view of the new and improved skateboard of the present invention illustrating the wear angle of the arc tail.

The arc-tail of the present invention is shown in FIG. 3 to include a first arc 350 on the upper surface 20 of the skateboard 10 of the present invention, and a second arcuate end 360 located on the bottom surface 62 of the skateboard. The radius of the first arcuate surface is equal to the horizontal distance from the end 352 of the board to the intersection point 312. The arcuate end 350 may be formed by any of a number of conventional woodworking approaches. The second arcuate termination 360 is formed in the following manner by reference to FIG. 7. A line from the intersection of the centerline 300 with the arcuate end 350 which is termed 352 for convenience is drawn tangential to the outer surface of the wheel 60 as shown at point 700. The tangential line is termed 702. A line is then drawn perpendicular to 702 through the tangent point 700 through the center of wheel 60 which is termed line 704. A line 706 is then drawn from point 352 and coincident with the upper surface 20 to the center of the axle 705. The angle between lines 702 and 706 formed at point 352 is termed the "wear angle" and is preferably 27.8°. However, a range of 27.8° ± 6° may be utilized and in fact any wear angle between 10° to 45° is effective. It is to be understood that the ideal wear angle, as shown in FIG. 8, allows the wear surface 900 of the skateboard 10 to be coplanar with the surface of the ground 902 when the skateboard 10 is tilted rearwardly in the direction of arrow 804 about the axle 705 of the wheel 60.

Since wheel diameters vary from different manufacturers and the distance from the ground to the bottom surface 62 of the board may also vary depending upon the truck assembly 710 which is used by the wheel manufacturer, the following design proportions should be maintained to practice the teachings of the present invention. The ratio of wheel diameter to the distance from the ground to the bottom of the board is preferably 0.6 to 0.8 but may range as broad as 0.5 to 0.9. The ratio providing the optimum result is 0.698. The ratio of the distance from the surface of the ground to the bottom of the board to the horizontal distance from the end of the board to centerline 310 ranges preferably between 0.35 and 0.45, but may range as broad as 0.25 to 0.55. The ratio providing the optimum result is 0.413.

Figure 9:
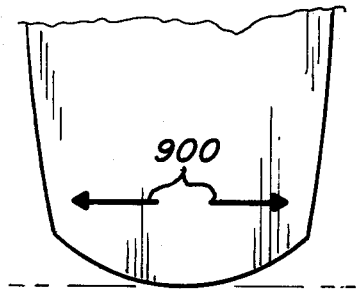
FIG. 9 is a diagrammatic illustration showing the use of the arc tail in executing turns.
Figure 8:
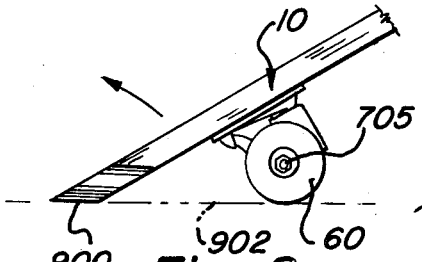
FIG. 8 is a diagrammatic illustration showing wear angle in operation.

By tilting back upon the improved skateboard 10, as shown in FIG. 8, the operator may quickly execute a turn by leaning right or left as indicated by the arrows 900 in FIG. 9. Indeed, in order to perform a "tail wheelie" the operator of the improved skateboard 10 of the present invention steers the skateboard downhill in order to gain speed. The operator then leans back gently in the direction of arrow 804 putting nearly all of his weight on his back foot until the end of the board on wear surface 800 starts scraping the ground. Under prior art approaches, conventional skateboards at this point in time are out of control. However, with the arc-tail design of the present invention, a shift of weight by the operator in the direction of arrow 900 will "rock" the board to the right or to the left in order to give smooth directional control. To come out of the "tail wheelie" the operator need merely shift his weight forward so that the skateboard comes down on all wheels.

A "360" is conventionally performed by going slowly on the ground, putting all of the weight of the operator on the tail to bring the front wheels off the ground and then pivoting quickly using the arms and shoulders to perform the pivot. With the improved skateboard 10 of the present invention, the 360 may be performed by starting out with the above-described wheelie turning 180° uphill in the wheelie position and then by pivoting the remaining 180° through use of the arms and shoulders.

A "540° Nose Helicopter" is conventionally performed by going slowly on the ground and by placing the feet of the operator close to the front wheels, thereby lifting the back wheels slightly and then pivoting quickly similar to the pivot of an ice skater for 540°. With the improved skateboard 10 of the present invention, however, the 540° is done with much greater speed from a much wider stance. The operator of the skateboard turns downhill, and puts his weight on his front foot, thereby lifting the back wheel up and pivoting 180° on the front wear surface, but not yet in contact with the ground. The 180° pivot causes the back wheels to be repositioned into the front wheel position. The operator then makes ground contact with that end of the board and pivots in the wheelie position for another 180° until he is pointing uphill. The operator releases the wheelie and pivots another 180° and ends up going down hill in a switched-stance.

Figure 10:
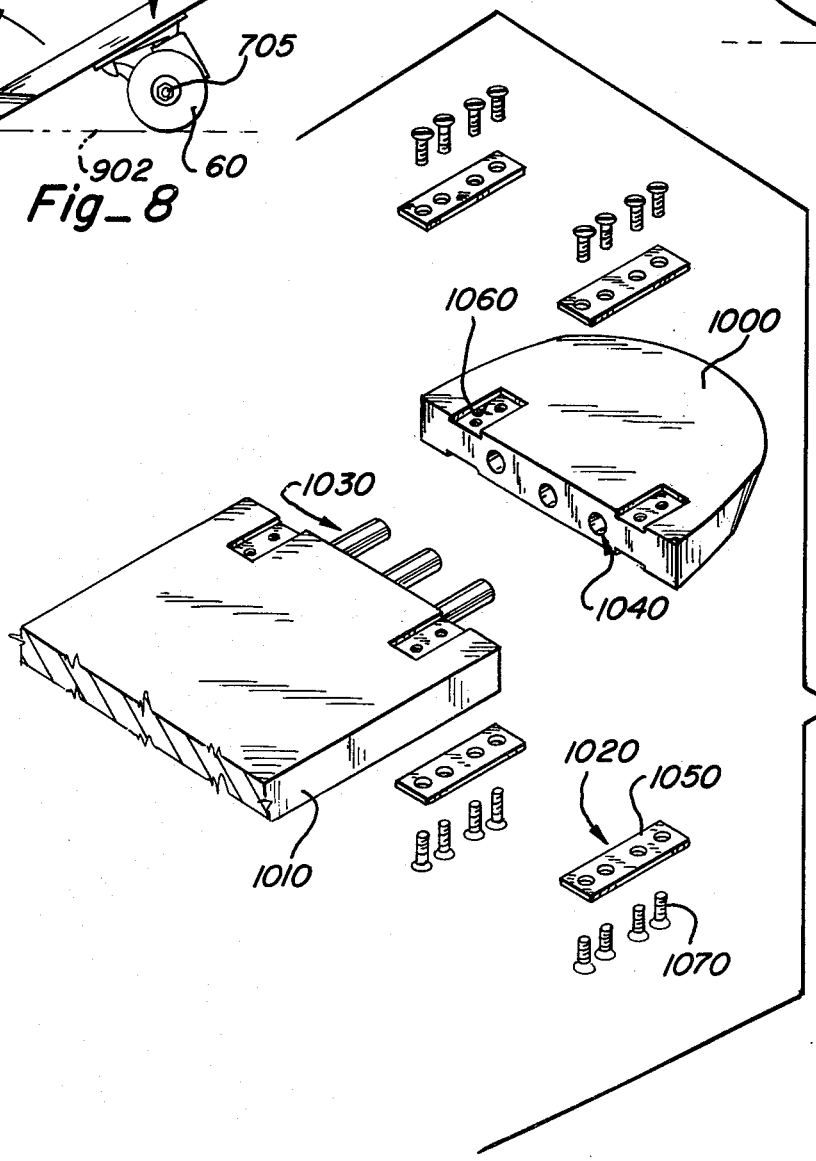
FIG. 10 is an exploded view illustrating one embodiment of the replace-a-tail of the present invention.

A "replace-a-tail" embodiment is shown in FIG. 10 to include a replaceable tail portion 1000 releasably and selectively connected to the main portion of the skateboard 10 by means of a coupler 1020. The coupler shown in FIG. 10, in the preferred embodiment, includes three dowel guides 1030 protruding from the main skateboard portion 1010, for guiding the replaceable tail 1000 in a correct orientation. In the replaceable tail portion 1000 are, therefore, formed three holes 1040 receptive of the dowels 1030. Furthermore, four hold down plates 1050 are used on each corner of the junction between the replace-a-tail portion 1000 and the main skateboard 1010. Each hold-down plate is mounted into a correspondingly shaped cavity 1060 and the hold down plate 1050 is firmly affixed thereto by means of screws 1070. The depth of the cavity 1060 is such that each hold down plate 1050 mounts flush to the upper and lower surfaces of the skateboard. Such an arrangement provides inexpensive means for reconditioning a skateboard whose tail ends have undergone extreme wear. While the arc-tail embodiment is shown in FIG. 10, the replace-a-tail concept is equally adaptable to the conventional skid tail or other conventional approaches.

Figure 11:
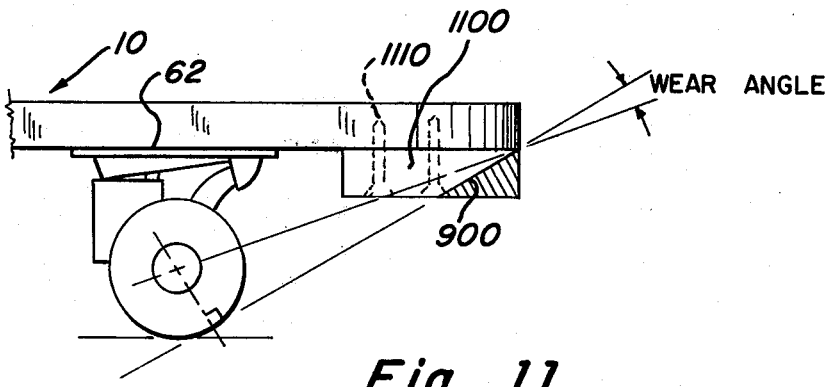
FIG. 11 is a side planar view of a second embodiment of a replace-a-tail of the present invention.
Figure 12:
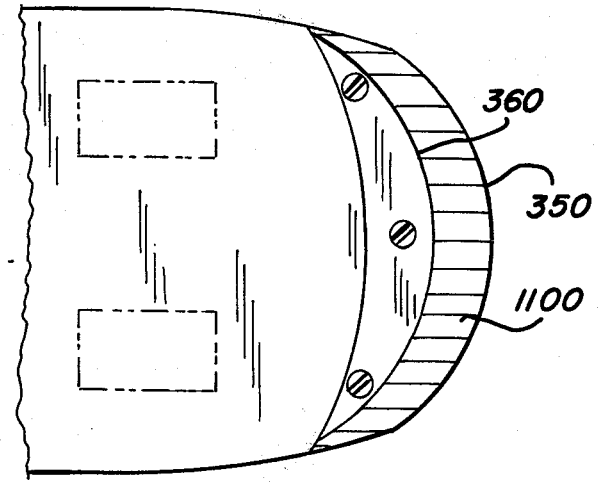
FIG. 12 is a bottom planar view of the replace-a-tail embodiment of FIG. 11.

Yet another embodiment of the "replace-a-tail" concept of the present invention is shown in FIGS. 11 and 12 to include a replaceable block 1100 manufactured in the shape and thickness as shown in FIGS. 11 and 12. In operation, the wearaway block 1100 is affixed to the bottom surface 62 of the skateboard 10, by means of screws 1110. The operator of the skateboard 10 wears the replaceable tail block in by conducting the above described wheelies and turns. The replaceable tail block 1100 wears away until the wear surface 900 is formed. The shaded portion of the block is shown in shaded lines to indicate the portion worn away.

Although the present invention has been described with a certain degree of particularity, it is understood that the present disclosure has been made by way of example and that changes in details of structure may be made without departing from the spirit thereof.

What is claimed is:

1. In a skateboard having wheels, and an integral board having upper and lower horizontal surfaces extending over said wheels, an improvement to said board comprising: at least one cavity formed in the lower surface of said board oriented over each of said wheels, said cavity extending from said lower horizontal surface of said board to a region below the upper horizontal surface of said board, said cavity being substantially triangular in shape at the intersection of said cavity with said lower horizontal surface, the shape of said cavity corresponding in shape to the surface of a cone segment, said cavity being oriented on said lower surface wherein a line drawn through the apex of said triangular shape on said lower horizontal surface nearest the longitudinal centerline of said board bifurcates said cavity and said line further intersects said longitudinal centerline at an angle between 45° and 75°.

2. In a skateboard having wheels and an integral board extending over said wheels, said board having a flat upper horizontal surface, the improvement to said board comprising:

a solid tail having a flat upper horizontal surface extending outwardly from at least one end of said board, said tail being formed in an inwardly directed arc on said flat upper horizontal surface at its end farthest from said board, and means for releasably coupling said tail to said one end, said tail when coupled to said board providing a flush horizontal surface from said flat upper horizontal surface of said board to said flat upper surface of said tail.

3. In a skateboard having wheels and an integral board extending over said wheels, said board having a flat upper horizontal surface, the improvement to said board comprising:

a solid tail having a flat upper horizontal surface extending outwardly from at least one end of said board, said tail being formed in an inwardly directed arc on said flat upper horizontal surface at its end farthest from said board, means for releasably coupling said tail to said one end, said tail when coupled to said board providing a flush horizontal surface from said flat upper horizontal surface of said board to said flat upper surface of said tail, and means on said one end of said board for orienting said tail onto said one end in said flush surface relationship.

4. In a skateboard having a plurality of wheels and an integral board extending over said pluarlity of wheels, said wheels being mounted in pairs on at least one axle, said board having upper and lower horizontal surfaces, the improvement to said board comprising a solid tail having a flat upper horizontal surface extending outwardly from at least one end of said board, said tail being formed in an inwardly directed arc on said upper horizontal surface and having said upper horizontal surface in the same plane as said upper horizontal surface of said board, said arc having a radius centered about a point on said upper surface of said board corresponding to the intersection of the longitudinal axis of said board and a line perpendicular to the board and extending through the center of the axle of the nearest set of wheels, the ratio of the diameter of each of said wheels to the distance from the bottom surface of said skateboard to the ground being in the range of 0.6 to 0.8 and the ratio of the distance from a point on the bottom horizontal surface of said board perpendicularly to ground in relation to said arc radius being in the range of 0.35 to 0.45.

5. In a skateboard having wheels located under opposing ends of a longitudinal board, said board having upper and lower horizontal surfaces, an improvement to at least one end of the board comprising:

said end terminating on said upper horizontal surface of said board in a first formed and inwardly directed arc, said end terminating on said lower horizontal surface in a second formed and inwardly directed arc, and an angular surface between said upper surface termination arc and said lower surface termination arc, said angular surface being oriented to lie between (a) a line intersecting said upper surface termination arc and a point tangential to the lower circumference of the nearest set of said wheels and (b) a line intersecting said upper surface termination arc and the center of said nearest set of wheels.

* * * * *